US012550934B2

(12) United States Patent
England et al.

(10) Patent No.: US 12,550,934 B2
(45) Date of Patent: Feb. 17, 2026

(54) FILTER FOR AEROSOL GENERATING DEVICE

(71) Applicant: BRITISH AMERICAN TOBACCO (INVESTMENTS) LIMITED, London (GB)

(72) Inventors: Will England, London (GB); Pablo Javier Ballesteros Gomez, London (GB); Thomas Woodman, London (GB); Jeremy Phillips, London (GB); Richard Hepworth, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 83 days.

(21) Appl. No.: 17/220,720

(22) Filed: Apr. 1, 2021

(65) Prior Publication Data

US 2021/0219601 A1 Jul. 22, 2021

Related U.S. Application Data

(62) Division of application No. 16/099,290, filed as application No. PCT/EP2017/062278 on May 22, 2017, now abandoned.

(30) Foreign Application Priority Data

May 20, 2016 (GB) ..... 1608947

(51) Int. Cl.

| | |
|---|---|
| ***A24D 3/06*** | (2006.01) |
| ***A24B 15/28*** | (2006.01) |
| ***A24D 1/20*** | (2020.01) |

(52) U.S. Cl.

CPC ..... *A24D 3/061* (2013.01); *A24B 15/283* (2013.01); *A24D 1/20* (2020.01)

(58) Field of Classification Search

CPC ..... A24D 1/20; A24D 3/061

See application file for complete search history.

(56) References Cited

U.S. PATENT DOCUMENTS

| | | | | |
|---|---|---|---|---|
| 4,889,144 | A | 12/1989 | Tateno et al. | |
| 5,499,636 | A * | 3/1996 | Baggett, Jr. | A24C 5/01 131/194 |
| 7,793,665 | B2 | 9/2010 | Dube et al. | |
| 7,972,254 | B2 * | 7/2011 | Stokes | A24D 3/061 493/47 |
| 8,739,802 | B2 | 6/2014 | Fagg | |

(Continued)

FOREIGN PATENT DOCUMENTS

| | | |
|---|---|---|
| EP | 2412396 | 2/2012 |
| EP | 3039972 | 7/2016 |

(Continued)

OTHER PUBLICATIONS

JP Notice of Reasons for Rejection for JP Application No. 2020-216794, dated Oct. 18, 2022, 5 pages.

(Continued)

*Primary Examiner* — Russell E Sparks

(74) *Attorney, Agent, or Firm* — MERCHANT & GOULD P.C.

(57) ABSTRACT

A filter for an aerosol generating device is disclosed. The filter contains a breakable capsule and the breakable capsule includes an aerosol modifier.

11 Claims, 4 Drawing Sheets

(56) References Cited

U.S. PATENT DOCUMENTS

| | | | | |
|---|---|---|---|---|
| 8,820,331 | B2 * | 9/2014 | Hartmann | A24D 3/0275 424/490 |
| 10,617,149 | B2 * | 4/2020 | Malgat | A24F 40/465 |
| 11,019,843 | B2 * | 6/2021 | Uthurry | A24D 3/18 |
| 2004/0261807 | A1 | 12/2004 | Dube et al. | |
| 2007/0074734 | A1 | 4/2007 | Braunshteyn et al. | |
| 2011/0005534 | A1 * | 1/2011 | Albino | A24D 1/00 131/202 |
| 2011/0104218 | A1 | 5/2011 | Karles et al. | |
| 2011/0136815 | A1 | 6/2011 | Zerbe et al. | |
| 2011/0232657 | A1 | 9/2011 | Karles et al. | |
| 2011/0271968 | A1 | 11/2011 | Carpenter et al. | |
| 2012/0017926 | A1 | 1/2012 | Karles et al. | |
| 2012/0067360 | A1 | 3/2012 | Conner et al. | |
| 2015/0027469 | A1 | 1/2015 | Tucker et al. | |
| 2015/0296874 | A1 | 10/2015 | Awty et al. | |
| 2015/0359264 | A1 | 12/2015 | Fernando | |

FOREIGN PATENT DOCUMENTS

| | | | | |
|---|---|---|---|---|
| GB | 1349537 | | 4/1974 | |
| GB | 2260253 | A * | 4/1993 | A24D 1/00 |
| JP | H8322538 | | 12/1996 | |
| JP | 2000325067 | | 11/2000 | |
| JP | 2007-259864 | A | 10/2007 | |
| JP | 2008546400 | | 12/2008 | |
| JP | 2013507906 | | 3/2013 | |
| JP | 2014-534818 | A | 12/2014 | |
| JP | 2014534818 | | 12/2014 | |
| JP | 2015533512 | A | 11/2015 | |
| JP | 2017506879 | A | 3/2017 | |
| JP | 2007259864 | | 10/2017 | |
| KR | 20120083738 | | 7/2012 | |
| WO | 2004041007 | A2 | 5/2004 | |
| WO | 2006097427 | | 9/2006 | |
| WO | 2006/136197 | A1 | 12/2006 | |
| WO | 2007010407 | | 1/2007 | |
| WO | 2009094859 | | 8/2009 | |
| WO | 2011045609 | A1 | 4/2011 | |
| WO | 2011077314 | | 6/2011 | |
| WO | 2012072676 | | 6/2012 | |
| WO | 2012138630 | A1 | 10/2012 | |
| WO | 2012156695 | | 11/2012 | |
| WO | 2012156703 | | 11/2012 | |
| WO | 2012156705 | | 11/2012 | |
| WO | 2013121608 | | 8/2013 | |
| WO | 2013173469 | | 11/2013 | |
| WO | 2014/068295 | A1 | 5/2014 | |
| WO | 2014/072735 | A1 | 5/2014 | |
| WO | 2014086998 | A1 | 6/2014 | |
| WO | 2014091605 | | 6/2014 | |
| WO | 2014158051 | A1 | 10/2014 | |
| WO | 2015036454 | | 3/2015 | |
| WO | 2015128028 | | 9/2015 | |
| WO | 2015/152017 | A1 | 10/2015 | |
| WO | 2015152017 | | 10/2015 | |
| WO | 2015166245 | A2 | 11/2015 | |
| WO | 2015166350 | | 11/2015 | |
| WO | 2015193242 | | 12/2015 | |
| WO | 2016/024206 | A1 | 2/2016 | |
| WO | 2016/063181 | A1 | 4/2016 | |
| WO | 2016063181 | | 4/2016 | |
| WO | 2016/092295 | A1 | 6/2016 | |
| WO | 2017/055456 | A1 | 4/2017 | |

OTHER PUBLICATIONS

EP Third Party Observation for EP Application No. 17729400.6, dated Jun. 28, 2021, 15 pages.

EP Third Party Observation for EP Application No. 17729400.6, dated Jan. 24, 2023, 4 pages.

International Preliminary Report on Patentability for Application No. PCT/EP2017/062274, mailed Nov. 29, 2018, 9 pages.

International Preliminary Report on Patentability for Application No. PCT/EP2017/062278, mailed Nov. 29, 2018, 8 pages.

International Search Report and Written Opinion for Application No. PCT/EP2017/062274, mailed on Aug. 16, 2017, 11 pages.

Swift et al., "Viscometric Method for Determining Free Menthol in Peppermind Oil", Industrial & Engineering Chemistry Analytical Edition, vol. 15, No. 7, Jul. 1943, pp. 422-423.

Verma et al., "Essential Oil Composition of Menthol Mint (Mentha Aervensis L.), and Peppermint (mentha peperita L.) Cultivars at Different Stages of Plant Growth from Kumaon Region of Western Himalaya", XP055395671, Open access Journal of Medicinal and Aromatic Plants, Jan. 1, 2010, pp. 13-18.

International Search Report and Written Opinion in Application No. PCT/EP2017/062278, mailed on Aug. 16, 2017, 3 pages.

Great Britain Search Report, Application No. GB1608947.6, dated Oct. 3, 2016, 4 pages.

"Office Action received for Japanese Patent Application No. 2018-555509, mailed on Jan. 7, 2020", 5 Pages (English Translation Only).

"Office Action received for Russian Patent Application No. 2018140731, mailed on Apr. 30, 2019", 15 pages (7 pages of English Translation and 8 pages of Official Copy).

Wikipedia article on shellac,version of Sep. 19, 2015 (https://en.wikipedia.org/w/index.php?title=Shellac&oldid=681766700).

Omoto et al., The latest technologies for the application of gellan gum, Progr Colloid Polym Sci (1999) 114:123-126.

EPO Notice of Opposition in EP Appln No. 17729400.6 dated Apr. 11, 2024, 69 pages.

JP Notice of Reasons for Rejection in Japanese Appln. No. 2023-085199, dated Jun. 4, 2024, 7 pages.

* cited by examiner

FILTER FOR AEROSOL GENERATING DEVICE

CROSS-REFERENCE TO RELATED APPLICATIONS

The present application is Divisional of U.S. patent application Ser. No. 16/099,290, filed Nov. 6, 2018, which is a National Phase entry of PCT Application No. PCT/EP2017/062278, filed May 22, 2017, which claims priority from GB Patent Application No. 1608947.6, filed May 20, 2016, each of which is hereby fully incorporated herein by reference.

TECHNICAL FIELD

The present disclosure relates to a filter for an aerosol generating device, the filter comprising a capsule. It also relates to a consumable for an aerosol generating device. It also relates to an aerosol generating device.

BACKGROUND

Articles such as cigarettes, cigars and the like burn tobacco during use to create tobacco smoke. Attempts have been made to provide alternatives to these types of articles, the said alternatives generating an inhalable aerosol without burning a substrate material. The material may be for example tobacco or other non-tobacco products or a combination, such as a blended mix, which may or may not contain nicotine.

An example of such aerosol generating products are the so-called heat-not-burn products, also known as tobacco heating products or tobacco heating devices, which release compounds by heating, but not burning, a solid substrate material to form an inhalable aerosol. Another example of such aerosol generating products are the so-called e-cigarette devices, which typically vaporize a liquid substrate to form an inhalable aerosol, which liquid substrate may or may not contain nicotine. Hybrid devices are also known, which vaporize both a liquid substrate and one or more components of a solid substrate material to form an inhalable aerosol.

SUMMARY

At its most general, the present disclosure provides a filter for an aerosol generating device, the filter comprising a capsule, the capsule comprising an aerosol modifier. Suitably, the aerosol modifier may comprise a flavorant.

According to a first aspect of the present disclosure, there is provided a filter for an aerosol generating device, the filter containing a breakable capsule and the breakable capsule comprising an aerosol modifier, suitably a flavorant.

The inventors have surprisingly found that the use of a breakable capsule provides an improved release profile for the aerosol modifier during use of the aerosol generating device. In particular, the inventors have surprisingly found that encapsulating the aerosol modifier using a breakable capsule provides sustained release of the aerosol modifier during heating.

According to a second aspect of the present disclosure, there is provided a consumable for an aerosol generating device, the consumable containing a filter according to the first aspect of the disclosure.

According to a third aspect of the present disclosure, there is provided an aerosol generating device containing a filter according to the first aspect of the disclosure or a consumable according to the second aspect of the disclosure.

According to a further aspect of the present disclosure, there is provided the use of a breakable capsule comprising an aerosol modifier in a filter for an aerosol generating device to provide sustained release of the aerosol modifier in use.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Further features and advantages of the disclosure will become apparent from the following description of embodiments of the disclosure, given by way of example only, which is made with reference to the accompanying drawings.

DETAILED DESCRIPTION

Figure 1:
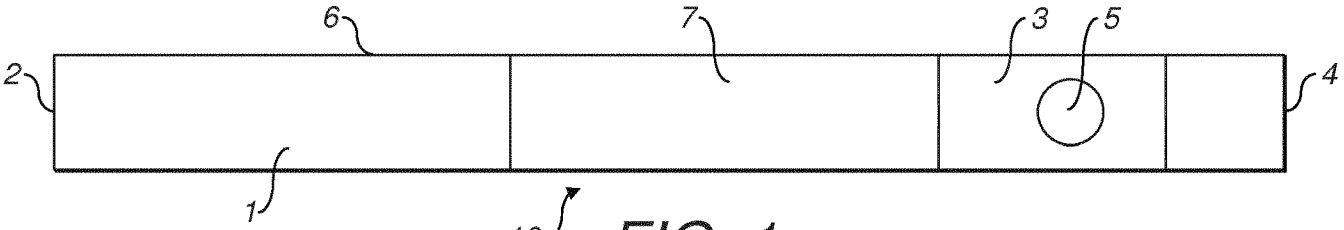
FIG. 1 shows a consumable for use with an aerosol generating device.

The inventors have observed that un-encapsulated, volatile aerosol modifiers, such as water or flavorants, are volatilized quickly during use of non-combustible aerosol generating products, with the result that the aerosol modifiers are consumed quickly and may not be delivered evenly throughout product use. Surprisingly, the inventors have found that the inclusion of a breakable capsule containing the aerosol modifier provides an improved release profile of that aerosol modifier compared with un-encapsulated aerosol modifier even though the capsule is ruptured before use. Data illustrating this effect can be seen in the examples. The improved release profile may alternatively be referred to as a sustained release profile.

Embodiments of the disclosure provide a filter for use in an aerosol generating device, the filter containing a breakable capsule and the breakable capsule comprising an aerosol modifier, suitably a flavorant. The filter may comprise a cellulosic material, a ceramic material, a polymer and/or activated carbon. Suitable examples of ceramic materials include silicon carbide (SiC), silicon nitride (Si3N4), titanium carbide, and zirconium dioxide (zirconia).

The filter may comprise a rod comprising first and second ends and a plurality of through-holes extending between the first and second ends.

In some cases, the pressure difference across the filter when the user inhales is in the range of 30 to 90 mmH2O, when the capsule is in an unbroken state. The inventors have determined that a pressure difference in this range is particularly suitable because (a) it is high enough to retain the aerosol modifier in the filter after the capsule has broken, thereby providing sustained release over time, and (b) it is low enough to let the aerosol pass through the filter and provide an acceptable consumption experience.

Suitably, the pressure difference across the filter may be in the range of from about 30 mmH2O, 33 mmH2O, 35 mmH2O, 38 mmH2O or 40 mmH2O to about 90 mmH2O, 75 mmH2O, 65 mmH2O, 60 mmH2O, 55 mmH2O or 50 mmH2O, when the capsule is in an unbroken state. Illustratively, the pressure difference across the filter when the capsule is in an unbroken state may be in the range of about 35-60 mmH2O, preferably 38-55 mmH2O or 40-50 mmH2O.

The pressure difference across the filter is affected by a number of parameters including the tow shape, tow mass per tip, the filter dimensions, the presence of absence of a plasticizer and, if present, the nature and amount of the plasticizer. The tow may be formed from cellulose acetate and may be 8Y1500 grade and/or 9.5Y1200 grade.

The filter may be a rod shape, suitably cylindrical. The filter may be approximately 8-14 mm in length, suitably 9-13 mm or 10-12 mm. It may have a cross-sectional diameter of approximately 5-9 mm, suitably 7.5-8 mm. It may be formed cellulose acetate fibers. It may contain a plasticizer such as triacetin. The tow may, for example, be Y-shaped in cross section, X-shaped in cross section or round-shaped in cross section.

In some cases, the filter contains only one capsule. In other cases, the filter contains more than one capsule. Where the filter comprises a plurality of capsules, the individual capsules may be the same as each other or may differ. For example, a plurality of capsules may be provided so that the user can select when/whether to break the capsule, thereby controlling the aerosol delivery profile.

The breakable capsule has a core-shell structure. That is, the encapsulating material or barrier material creates a shell around a core that comprises the aerosol modifier.

The shell structure hinders migration of the aerosol modifier during storage of the aerosol generating device but allows controlled release of the aerosol modifier during use.

In some cases, the barrier material (also referred to herein as the encapsulating material) is frangible. The capsule is crushed or otherwise fractured or broken by the user to release the encapsulated aerosol modifier. Typically, the capsule is broken immediately prior to heating being initiated but the user can select when the release the aerosol modifier. The term "breakable capsule" refers to a capsule, wherein the shell can be broken by means of a pressure to release the core; more specifically the shell can be ruptured under the pressure imposed by the user's fingers when the user wants to release the core of the capsule.

In some cases, the barrier material is heat resistant. That is to say, in some cases, the barrier will not rupture, melt or otherwise fail at the temperature reached at the capsule site during operation of the aerosol generating device. Illustratively, a capsule located in a filter may be exposed to temperatures in the range of 30° C. to 100° C. for example, and the barrier material may continue to retain the liquid core up to at least about 50° C. to 120° C.

In other cases, the capsule releases the core composition on heating, for example by melting of the barrier material or by capsule swelling leading to rupture of the barrier material.

The total weight of a capsule may be in the range of about 1 mg to about 100 mg, suitably about 5 mg to about 60 mg, about 10 mg to about 50 mg, about 15 mg to about 40 mg, or about 15 mg to about 30 mg.

The total weight of the core formulation may be in the range of about 2 mg to about 90 mg, suitably about 3 mg to about 70 mg, about 5 mg to about 25 mg, about 8 mg to about 20 mg, or about 10 mg to about 15 mg.

The capsule according to the invention comprises a core as described above, and a shell. The capsules may present a crush strength from about 4.5 N to about 40 N or to about 25 N.

The capsules may be substantially spherical and have a diameter of at least about 0.4 mm, 0.6 mm, 0.8 mm, 1.0 mm, 2.0 mm, 2.5 mm, 2.8 mm or 3.0 mm. The diameter of the capsules may be less than about 10.0 mm, 8.0 mm, 7.0 mm, 6.0 mm, 5.5 mm, 5.0 mm, 4.5 mm, 4.0 mm, 3.5 mm or 3.2 mm. Illustratively, the capsule diameter may be in the range of about 0.4 mm to about 10.0 mm, about 0.8 mm to about 6.0 mm, about 2.5 mm to about 5.5 mm or about 2.8 mm to about 3.2 mm. In some cases, the capsule may have a diameter of about 3.0 mm. These sizes are particularly suitable for incorporation of the capsule into an aerosol generating device.

The barrier material may comprise one or more of a gelling agent, a bulking agent, a buffer, a coloring agent and a plasticizer.

Suitably, the gelling agent may be, for example, a polysaccharide or cellulosic gelling agent, a gelatin, a gum, a gel, a wax or a mixture thereof. Suitable polysaccharides include alginates, dextrans, maltodextrins, cyclodextrins and pectins. Suitable alginates include, for instance, a salt of alginic acid, an esterified alginate or glyceryl alginate. Salts of alginic acid include ammonium alginate, triethanolamine alginate, and group I or II metal ion alginates like sodium, potassium, calcium and magnesium alginate. Esterified alginates include propylene glycol alginate and glyceryl alginate. In an embodiment, the barrier material is sodium alginate and/or calcium alginate. Suitable cellulosic materials include methyl cellulose, ethyl cellulose, hydroxyethyl cellulose, hydroxypropyl cellulose, carboxymethyl cellulose, cellulose acetate and cellulose ethers. The gelling agent may comprise one or more modified starches. The gelling agent may comprise carrageenans. Suitable gums include agar, gellan gum, gum Arabic, pullulan gum, mannan gum, gum ghatti, gum tragacanth, Karaya, locust bean, acacia gum, guar, quince seed and xanthan gums. Suitable gels include agar, agarose, carrageenans, furoidan and furcellaran. Suitable waxes include carnauba wax. In some cases, the gelling agent may comprise carrageenans and/or gellan gum; these gelling agents are particularly suitable for inclusion as the gelling agent as the pressure required to break the resulting capsules is particularly suitable.

The barrier material may comprise one or more bulking agents, such as starches, modified starches (such as oxidized starches) and sugar alcohols such as maltitol.

The barrier material may comprise a coloring agent which renders easier the location of the capsule within the aerosol generating device during the manufacturing process of the aerosol generating device. The coloring agent can be chosen among colorants and pigments.

The barrier material may further comprise at least one buffer, such as a citrate or phosphate compound.

The barrier material may further comprise at least one plasticizer, which may be glycerol, sorbitol, maltitol, triacetin, polyethylene glycol, propylene glycol or another polyalcohol with plasticizing properties, and optionally one acid of the monoacid, diacid or triacid type, especially citric acid, fumaric acid, malic acid, and the like. The amount of plasticizer ranges from 1% to 30% by weight, such as from 2% to 15% by weight, and for example from 3 to 10% by weight of the total dry weight of the shell.

The barrier material may also comprise one or more filler materials. Suitable filler materials include comprising starch derivatives such as dextrin, maltodextrin, cyclodextrin (alpha, beta or gamma), or cellulose derivatives such as hydroxypropyl-methylcellulose (HPMC), hydroxypropylcellulose (HPC), methylcellulose (MC), carboxy-methylcellulose (CMC), polyvinyl alcohol, polyols or mixture thereof. Dextrin can be a filler. The amount of filler in the shell is at most 98.5%, such as from 25 to 95%, for example from 40 to 80%, or for example from 50 to 60% by weight on the total dry weight of the shell.

The capsule shell may additionally comprise a hydrophobic outer layer which reduces the susceptibility of the capsule to moisture-induced degradation. The hydrophobic outer layer is suitably selected from the group comprising waxes, especially carnauba wax, candelilla wax or beeswax, carbowax, shellac (in alcoholic or aqueous solution), ethyl cellulose, hydroxypropyl methyl cellulose, hydroxyl-propylcellulose, latex composition, polyvinyl alcohol, or a combination thereof. For example, the at least one moisture barrier agent is ethyl cellulose or a mixture of ethyl cellulose and shellac.

The capsule core comprises the aerosol modifier. This aerosol modifier may be any volatile substance which modifies at least one property of the aerosol. For example, the aerosol substance may [modify the pH, the sensorial properties, the water content, the delivery characteristics or the flavor. In some cases, the aerosol modifier may be selected from an acid, a base, water or a flavourant. In some embodiments, the aerosol modifier comprises one or more flavorants.

As used herein, the terms "flavor", "flavoring" and "flavorant" refer to materials which, where local regulations permit, may be used to create a desired taste or aroma in a product for adult consumers. They may include extracts (e.g., licorice, *Hydrangea*, Japanese white bark *Magnolia* leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *Cassia*, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The flavorant may suitably be licorice, rose oil, vanilla, lemon oil, orange oil, a mint-flavor, suitably menthol and/or a mint oil from any species of the genus Mentha such as peppermint oil and/or spearmint oil, or lavender, fennel or anise.

In some cases, the flavorant comprises menthol.

In some cases, the capsule may comprise at least about 25% w/w flavorant (based on the total weight of the capsule), suitably at least about 30% w/w flavorant, 35% w/w flavorant, 40% w/w flavorant, 45% w/w flavorant or 50% w/w flavorant.

In some cases, the core may comprise at least about 25% w/w flavorant (based on the total weight of the core), suitably at least about 30% w/w flavorant, 35% w/w flavorant, 40% w/w flavorant, 45% w/w flavorant or 50% w/w flavorant. In some cases, the core may comprise less than or equal to about 75% w/w flavorant (based on the total weight of the core), suitably less than or equal to about 65% w/w flavorant, 55% w/w flavorant, or 50% w/w flavorant. Illustratively, the capsule may include an amount of flavorant in the range of 25-75% w/w (based on the total weight of the core), about 35-60% w/w or about 40-55% w/w.

The capsules may include at least about 2 mg, 3 mg or 4 mg of the aerosol modifier, suitably at least about 4.5 mg the aerosol modifier, 5 mg the aerosol modifier, 5.5 mg the aerosol modifier or 6 mg the aerosol modifier.

In some cases, the consumable comprises at least about 7 mg of the aerosol modifier, suitably at least about 8 mg the aerosol modifier, 10 mg the aerosol modifier, 12 mg the aerosol modifier or 15 mg the aerosol modifier.

The core may also comprise a solvent which dissolves the aerosol modifier. Any suitable solvent may be used.

Where the aerosol modifier comprises a flavorant, the solvent may suitably comprise short or medium chain fats and oils. For example, the solvent may comprise tri-esters of glycerol such as C2-C12 triglycerides, suitably C6-C10 triglycerides or C8-C12 triglycerides. For example, the solvent may comprise medium chain triglycerides (MCT-C8-C12), which may be derived from palm oil and/or coconut oil.

The esters may be formed with caprylic acid and/or capric acid. For example, the solvent may comprise medium chain triglycerides which are caprylic triglycerides and/or capric tryglycerides. For example, the solvent may comprise compounds identified in the CAS registry by numbers 73398-61-5, 65381-09-1, 85409-09-2. Such medium chain triglycerides are odorless and tasteless.

The hydrophilic-lipophilic balance (HLB) of the solvent may be in the range of 9 to 13, suitably 10 to 12.

Methods of making the capsules include co-extrusion, optionally followed by centrifugation and curing and/or drying. The contents of WO 2007/010407 A2 is incorporated by reference, in its entirety.

A second aspect of the disclosure provides a consumable for an aerosol generating device which contains a filter according to the first aspect of the disclosure. This consumable may alternatively be referred to as a cartridge for an aerosol generating device.

In some cases, the consumable comprises a filter according to the first aspect of the disclosure and one or more of an aerosol generating agent and a tobacco material. Generally, the filter is placed downstream of the tobacco material and/or the aerosol generating agent, so that the aerosol generated in use is modified by the aerosol modifier whilst passing through the filter.

In some cases, the consumable comprises a filter according to the first aspect of the disclosure and one or more of an aerosol generating agent, a flavorant (in addition to any encapsulated flavorant) and a tobacco material.

In some cases, the consumable contains only one capsule. In other cases, the consumable contains more than one capsule. Where the consumable comprises a plurality of capsules, the individual capsules may all be provided within the filter, or may be distributed through the consumable. For example, there may be one capsule in the filter and another in a tobacco portion of the consumable. Where the consumable comprises a plurality of capsules, the individual capsules may be the same as each other or may differ. For example, a plurality of capsules may be provided so that the user can select when/whether to break the capsule, thereby controlling the flavor profile.

As illustrated in FIG. 1, the consumable 10 may be substantially cylindrical in shape. It may include a tobacco rod 1 at towards a first end 2 and a filter 3 towards the second end 4. The second end 4 is a mouthpiece end. The tobacco rod 1 comprises tobacco material. The capsule 5 is disposed within the consumable 10 within the filter 3. The filter may be formed from cellulose acetate. A paper sheath 6 retains the components in the cylindrical configuration and provides a passage 7 between the tobacco rod 1 and filter 3. A further short passage is shown between the filter 3 and the second end 4. This may be omitted in an alternative embodiment.

In some cases, the tobacco rod 1 is between 34 mm and 50 mm in length, or the tobacco rod 1 is between 38 mm and 46 mm in length, or the tobacco rod 1 is 42 mm in length.

In some cases, the total length of the consumable 10 is between 71 mm and 95 mm, or between 79 mm and 87 mm, or the total length of the consumable 10 is 83 mm.

The paper sheath 6 may extend from the second end 4 of the consumable to the first end 2. Alternatively, it may extend from the second end 4 so that it reaches end of the tobacco rod 1 proximal to the second end 4. In some cases, the paper sheath 4 may be between 42 mm and 50 mm in length, suitably 46 mm.

In some cases, the filter may be between 8 mm and 14 mm in length, suitably from 9 mm to 13 mm or from 10 mm to 12 mm.

In some cases, the short passage between the filter 3 and the second end 4 may be from 3 mm to 7 mm in length, suitably from 4 mm to 6 mm. The total length of this short passage and the filer may suitably be from about 15 mm to about 17 mm in some cases.

In some cases, the capsule may be located centrally in the filter. That is to say, the capsule may be positioned approximately half way along the length of the filter.

In some cases, the passage 7 is at least 15 mm. In some cases, the length of the passage 7 is between 20 mm and 30 mm, more particularly 23 mm to 27 mm, more particularly 25 mm to 27 mm and more particularly 25 mm. This passage 7 may allow condensation of volatilized components of the tobacco rod to from an aerosol. The passage 7 may be provided to limit the temperature experienced by the heat-sensitive filter and capsule, preventing damage to these components.

In alternative embodiments, the substantially cylindrical consumable may include the tobacco rod immediately adjacent to the filter. A passage may be provided on the opposite side of the filter to the tobacco, or there may be no passageway.

In some embodiments, one or more additional capsule(s) may be disposed within the consumable adjacent to or within tobacco rod.

The consumable is at least partly inserted into the aerosol generating device in use so that it can be heated to from an inhalable aerosol. The consumable may comprise a heated portion which is inserted into the aerosol generating device, and a mouthpiece portion which protrudes from the aerosol generating device, through which the aerosol is inhaled. The mouthpiece portion is not heated directly by the heater. In some cases, the capsule may be provided in the mouthpiece portion, within the filter. In some cases, the capsule may be provided in the heated portion.

A ventilation region (not illustrated) may be provided in the consumable 10, to enable air to flow into the interior of the consumable 10 from the exterior. In one case, the ventilation region takes the form of one or more ventilation holes formed through the outer layer of the consumable 10. The ventilation holes may be located in the passage 7, to aid with the cooling of the aerosol in use. In one example, the ventilation region comprises one or more rows of holes, and preferably, each row of holes is arranged circumferentially around the consumable 10 in a cross-section that is substantially perpendicular to a longitudinal axis of the consumable 10.

In one example, there are between one to four rows of ventilation holes to provide ventilation for the consumable 10. Each row of ventilation holes may have between 12 to 36 ventilation holes. The ventilation holes may, for example, be between 100 to 500 μm in diameter. In one example, an axial separation between rows of ventilation holes is between 0.25 mm and 0.75 mm, more preferably, an axial separation between rows of ventilation holes is 0.5 mm.

In one example, the ventilation holes are of uniform size. In another example, the ventilation holes vary in size. The ventilation holes can be made using any suitable technique, for example, one or more of the following techniques: laser technology, mechanical perforation of the passage 7 walls, or pre-perforation of the pass 7 walls before the consumable is formed.

The ventilation holes are positioned so as to provide effective cooling to the consumable 10.

In one example, the rows of ventilation holes are located at least 11 mm from the second end 4 of the consumable 10, more preferably the ventilation holes are located between 17 mm and 20 mm from the second end 4 of the consumable 10. The location of the ventilation holes is positioned such that user does not block the ventilation holes when the consumable 10 is in use. Advantageously, providing the rows of ventilation holes between 17 mm and 20 mm from the second end 4 of the consumable 10 enables the ventilation holes to be located outside of aerosol generating device in use. By locating the ventilation holes outside of the device, non-heated air is able to enter the consumable 10 through the ventilation holes to aid with the cooling of the aerosol in use.

In some embodiments, the filter and tobacco may be inserted into the aerosol generating device separately. The apparatus may be configured such that the filter is in the mouthpiece portion and the tobacco is in the heated portion.

After use, the consumable and/or the filter is removed and typically disposed of. Subsequent uses of the aerosol generating device use further consumables.

The term "aerosol generating device" as used herein refers to non-combustible devices. In some embodiments, the aerosol generating device is a so-called tobacco heating product, also known as a heat-not-burn product or tobacco heating device, which release compounds by heating, but not burning, a solid or semi-solid substrate material. The capsules are configured to release the aerosol modifier (such as a flavorant) at the operating temperature of such devices.

In addition to the filter containing a capsule, the tobacco heating product may additionally contain one or more of an aerosol generating agent, flavorants (in addition to any encapsulated flavorant), a tobacco material and further capsules. The further capsules may be in the filter or may be in another part of the tobacco heating product.

The tobacco heating product may comprise one or more of a substrate chamber, a heater and a cooling chamber. The substrate material that is heated but not burned during use, may be provided in the substrate chamber. The substrate chamber is heated by the heater in use to vaporize constituents of the substrate.

In some cases, the filter may be provided in the substrate chamber. In some cases, the filter may be provided in the cooling chamber.

In an embodiment, the heater is disposed around the substrate chamber to form an oven-type arrangement in which the substrate is heated during use.

The cooling chamber is not exposed to heat in use; the one or more vaporized constituents condenses in the cooling chamber to form an aerosol. In some embodiments, the cooling chamber may be the passage 7 illustrated in FIG. 1. The cooling chamber may be in a mouthpiece portion of the aerosol generating device, and the mouthpiece portion is not exposed to the heater. The generated aerosol is inhaled through the mouthpiece portion in use. In some cases, the filter may be included in the cooling chamber, wherein the aerosol modifier (released from the broken capsule) is volatilized by residual heat in the aerosol formed from the heated substrate.

In some cases, the filter may be provided in the substrate chamber. The filter may be included in the substrate chamber so that the capsule contents are heating directly by the heater in use.

In some cases, the aerosol generating device contains only one capsule. In some cases, there may be more than one capsule and the core composition of each capsule is different.

As used herein, the term "aerosol generating agent" refers to an agent that promotes the generation of an aerosol. An aerosol generating agent may promote the generation of an aerosol by promoting an initial vaporization and/or the condensation of a gas to an inhalable solid and/or liquid aerosol.

Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

EXAMPLES

FIGS. 2 to 6 each relate to a tobacco heating product loaded with menthol flavoring. Each peak in the time profile corresponds to a puff, and the amount of nicotine and menthol in each puff was detected by TOF mass spectrometry. In each figure, the upper trace is menthol and the lower trace is nicotine.

Figure 2:
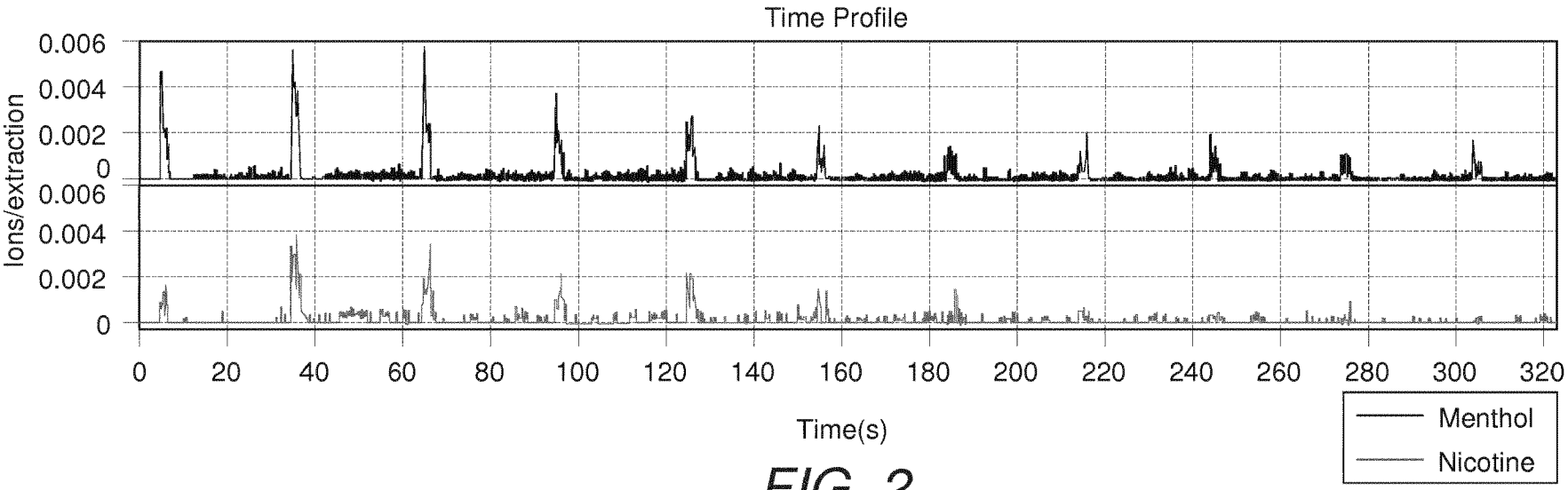
FIG. 2 illustrates flavorant delivery per puff for an aerosol generating device in which the rod of tobacco material was impregnated with flavorant; no encapsulation of the flavorant was used.

In FIG. 2, the rod of tobacco material was impregnated with menthol; no encapsulation of the menthol was used. This therefore represents a comparative example.

Impregnation of the tobacco rod with menthol can be achieved by, for example, spraying a menthol solution onto the rod or by injecting the solution into the rod.

It can be seen that substantial menthol delivery in the early puffs was detected, but that the quantity of menthol delivered tailed off and was significantly reduced in the later puffs.

Figure 3:
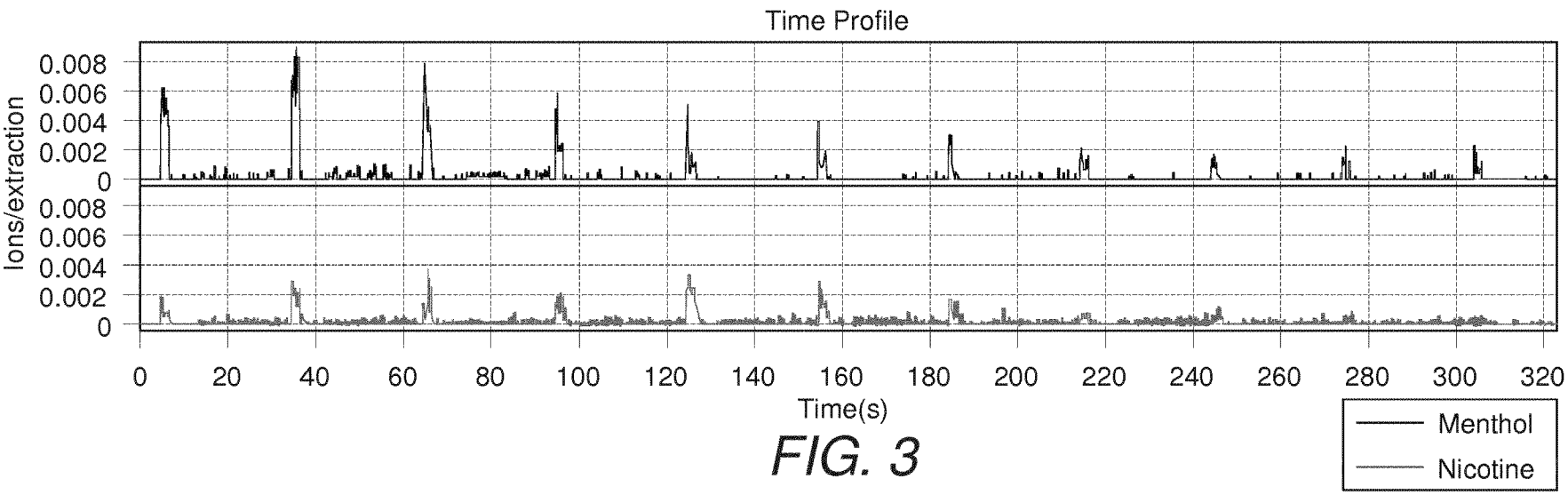
FIG. 3 illustrates flavorant delivery per puff for an aerosol generating device in which the filter was impregnated with flavorant; no encapsulation of the flavorant was used.

In FIG. 3, the filter was impregnated with menthol; no encapsulation of the menthol was used. This therefore represents a comparative example.

Impregnation of the filter with menthol can be achieved by, for example, including menthol dissolved in propylene glycol during the manufacturing process.

It can be seen that substantial menthol delivery in the early puffs was detected, but that the quantity of menthol delivered tailed off and was significantly reduced in the later puffs.

Figure 4:
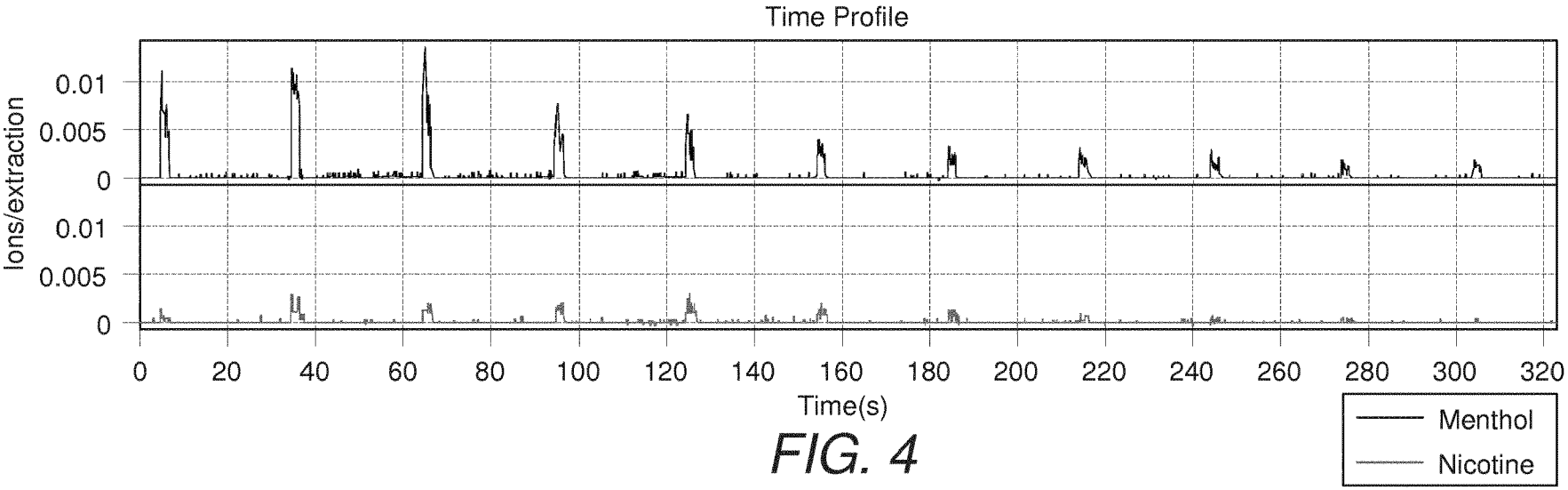
FIG. 4 illustrates flavorant delivery per puff for an aerosol generating device in which the filter and the rod of tobacco material were both impregnated with flavorant; no encapsulation of the flavorant was used.

In FIG. 4, the filter and the rod of tobacco material were both impregnated with menthol; no encapsulation of the menthol was used. This therefore represents a comparative example.

It can be seen that substantial menthol delivery in the early puffs was detected, but that the quantity of menthol delivered tailed off and was significantly reduced in the later puffs.

Figure 5:
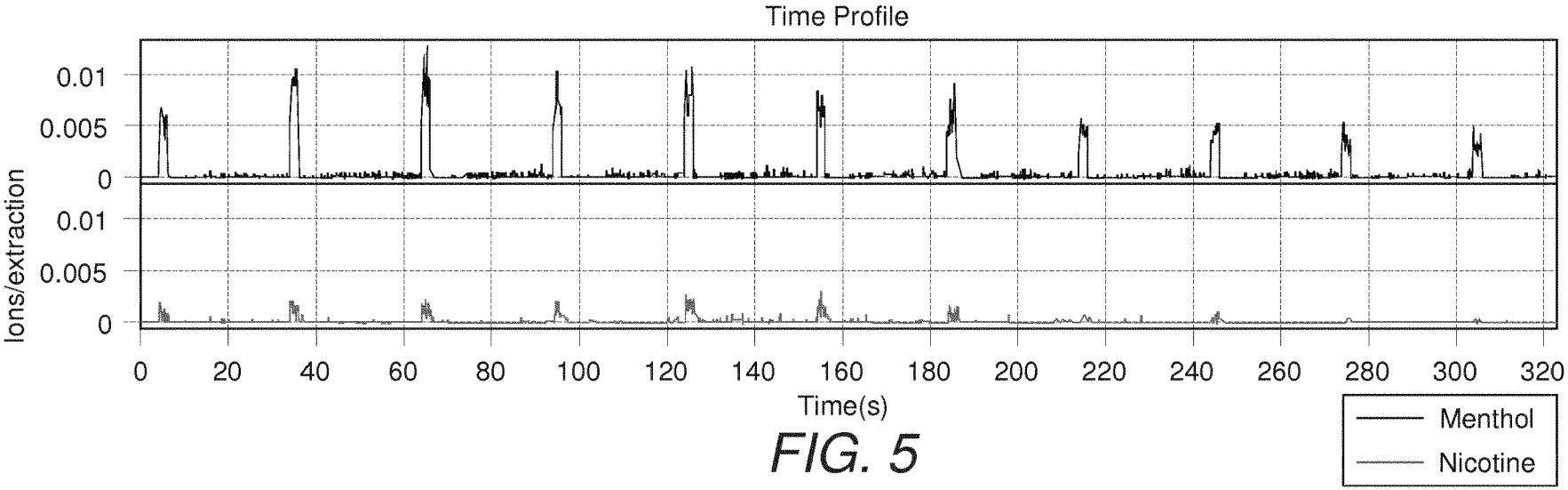
FIG. 5 illustrates flavorant delivery per puff for an aerosol generating device in which a capsule containing flavorant was included within the filter, as illustrated in FIG. 1. No other flavorant was included.

In FIG. 5, a capsule containing menthol was included within to the filter, as illustrated in FIG. 1. No other menthol was included.

It can be seen that menthol delivery was sustained across the product use-time. Substantial quantities of menthol were delivered in each puff.

Figure 6:
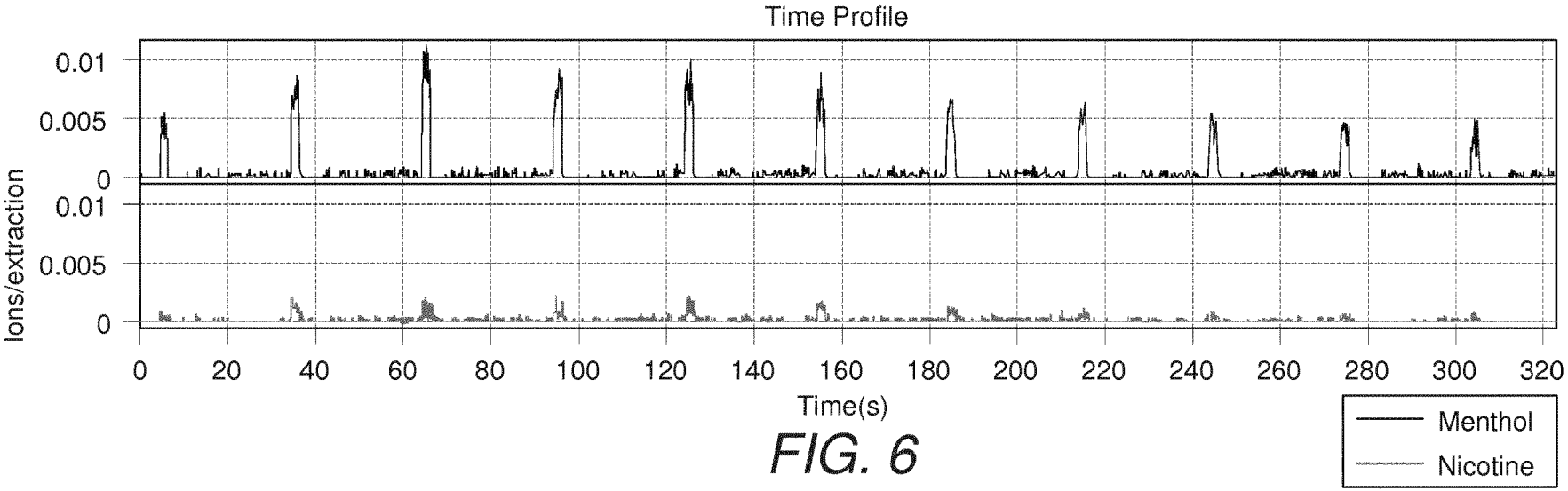
FIG. 6 illustrates flavorant delivery per puff for an aerosol generating device in which a capsule containing flavorant was included within the filter, as illustrated in FIG. 1. Flavorant was also impregnated into the rod of tobacco material.

In FIG. 6, a capsule containing menthol was included within to the filter, as illustrated in FIG. 1. Menthol was also impregnated into the rod of tobacco material. It can be seen that menthol delivery was sustained across the product use-time.

Substantial quantities of menthol were delivered in each puff.

It can be seen from FIGS. 5 and 6 that sustained delivery of the aerosol modifier (menthol) is provided by the encapsulation. This is surprising, particularly given that the capsule is placed within the filter, and given that a mentholated filter does not give the same sustained release, as can be seen in FIGS. 3 and 4.

Figure 7:
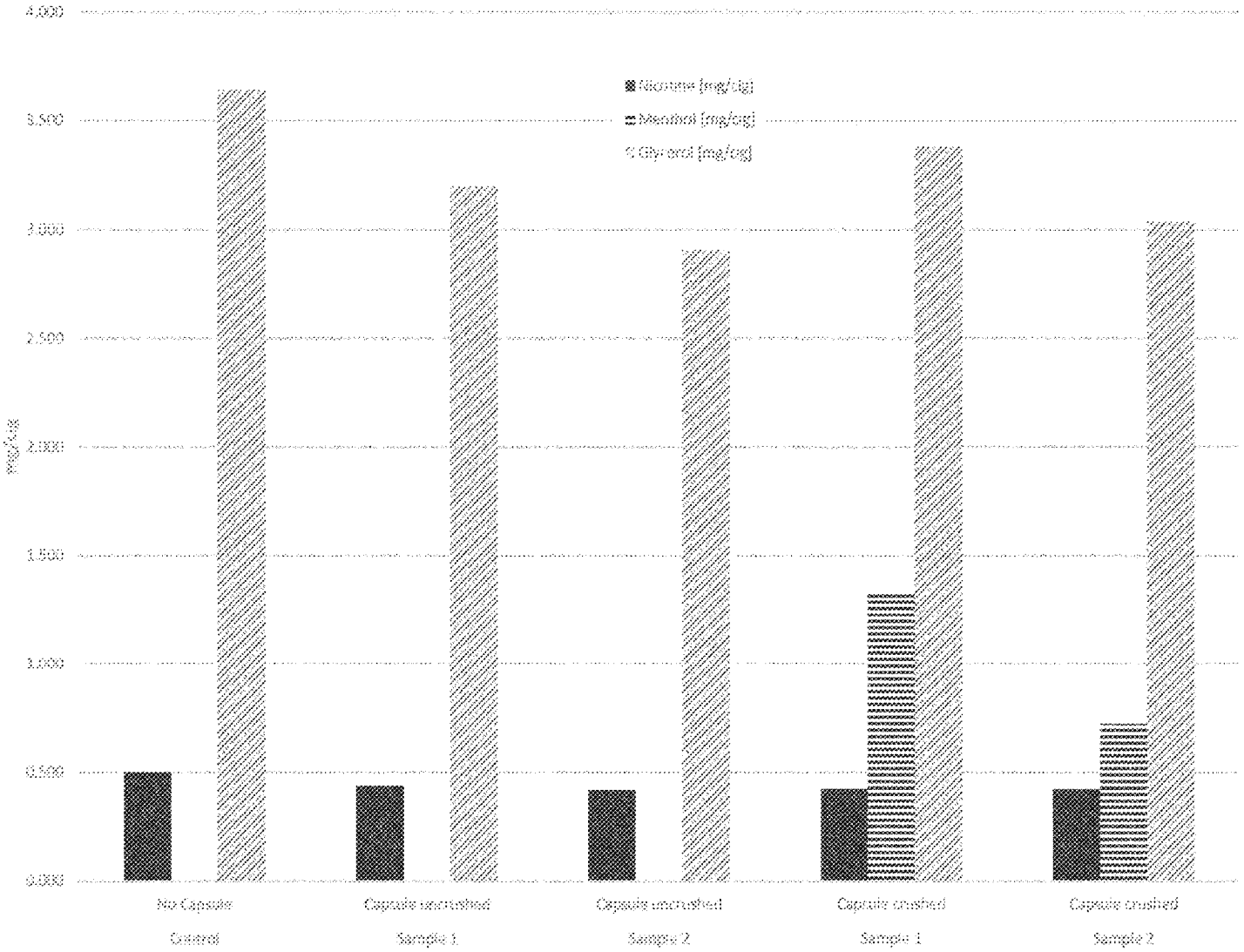
FIG. 7 illustrates the effect of including a capsule containing menthol in a filter on the delivery of nicotine, glycerol and menthol.

FIG. 7 illustrates the effect of including a capsule containing menthol in the filter of a consumable on the delivery of menthol, nicotine and glycerol.

In each case, the total delivery of each component was detected using a puff regime in which 8 55 mL puffs were taken at 30 second intervals. Each puff lasted 2 seconds.

In each case, the filer comprised cellulose acetate and the pressure difference across the filter on each puff was 42 mmH2O. A capsule containing menthol was included in the filter for sample 1 and for sample 2; the capsule differed between these two samples.

It can be seen that inclusion of the capsule in the filter results in a small drop in the delivery of nicotine and glycerol. The amount of these components delivered in sample 1 and sample 2 is lower than in the control sample but is high enough to generate an acceptable experience for the consumer.

It can also be seen that the delivery of nicotine and glycerol is not compromised on crushing of the capsule, whilst substantial delivery of the encapsulated menthol is achieved.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in the future.

What is claimed is:

1. A consumable for an aerosol generating device, the consumable arranged to be at least partly inserted into the aerosol generating device in use so that the consumable can be heated by a heater of the aerosol generating device to form an inhalable aerosol, the consumable comprising:

a heated portion in the form of a tobacco rod which is inserted into the aerosol generating device in use and heated by the heater; and a mouthpiece portion, through which aerosol is inhaled in use, wherein the mouthpiece portion comprises:

a filter containing a breakable capsule, wherein the breakable capsule has a core-shell structure and the core is a liquid core comprising an aerosol modifier encapsulated by a barrier material, where the barrier material is capable of retaining the liquid core up to at least 50° C. to 120° C.;

wherein the core comprises at least one solvent selected from short chain fats, medium chain fats, short chain oils and medium chain oils;

wherein the capsule has a diameter in the range of about 2.5 mm to about 5.5 mm and a weight in the range of about 15 mg to about 30 mg; and a cooling chamber formed as a passage between the tobacco rod and the filter, wherein the length of the passage is between 20 mm and 30 mm, and the consumable comprises a ventilation region comprising one or more holes to enable non-heated air to flow into the cooling chamber from an exterior, wherein the one or more holes are located at least 11 mm from a downstream end of the mouthpiece portion.

2. The consumable according to claim 1, wherein a pressure difference across the filter when a user inhales is in a range of 30 mmH2O to 90 mmH2O, when the breakable capsule is in an unbroken state.

3. The consumable according to claim 2, wherein the pressure difference across the filter when the user inhales is in the range of 35 mmH2O to 60 mmH2O when the breakable capsule is in the unbroken state.

4. The consumable according to claim 1, wherein the aerosol modifier comprises a flavorant.

5. The consumable according to claim 4, wherein the core comprises at least about 25% w/w of the flavorant, based on the total weight of the core.

6. The consumable according to claim 1, wherein the barrier material comprising one or more of a gelling agent, a bulking agent, a coloring agent, a plasticizer, or a filler material.

7. The consumable according to claim 1, wherein the mouthpiece portion is not directly heated in use.

8. The consumable according to claim 3, wherein the pressure difference across the filter when the user inhales is in the range of 38 mmH2O to 55 mmH2O when the breakable capsule is in the unbroken state.

9. The consumable according to claim 8, wherein the pressure difference across the filter when the user inhales is in the range of 40 mmH2O to 50 mmH2O when the breakable capsule is in the unbroken state.

10. The consumable according to claim 4, wherein the flavorant is menthol.

11. The consumable according to claim 1, wherein the breakable capsule comprises at least 4 mg of the aerosol modifier.

* * * * *